US012467239B2

(12) United States Patent
Armstrong et al.

(10) Patent No.: US 12,467,239 B2
(45) Date of Patent: Nov. 11, 2025

(54) MACHINE WITH A BOOM LINK AND POSITION SENSOR

(71) Applicant: Caterpillar Inc., Peoria, IL (US)

(72) Inventors: Vincent Adam Armstrong, Mooresboro, NC (US); Joshua D. Callaway, Cary, NC (US); Christopher Erik Bright, Raleigh, NC (US); Benjamin J. Terry, Wilson, NC (US); Michael C. Layko, Apex, NC (US)

(73) Assignee: Caterpillar Inc., Peoria, IL (US)

( * ) Notice: Subject to any disclaimer, the term of this patent is extended or adjusted under 35 U.S.C. 154(b) by 773 days.

(21) Appl. No.: 17/824,410

(22) Filed: May 25, 2022

(65) Prior Publication Data

US 2023/0383501 A1 Nov. 30, 2023

(51) Int. Cl.
*E02F 9/26* (2006.01)
*E02F 3/36* (2006.01)

(52) U.S. Cl.
CPC ..... *E02F 9/264* (2013.01); *E02F 3/3604* (2013.01)

(58) Field of Classification Search
CPC ..... E02F 3/3604; E02F 3/384; E02F 9/264; E02F 9/2214; E02F 9/2296; E02F 9/2285
See application file for complete search history.

(56) References Cited

U.S. PATENT DOCUMENTS 6,564,480 B1 5/2003 Tomita et al.
9,115,483 B2 * 8/2015 Sakuda ..... G01D 5/264
9,481,984 B2 11/2016 Komatsu
9,909,282 B2 3/2018 Komatsu
2004/0045289 A1 3/2004 Ikeda et al.
2022/0081876 A1 * 3/2022 Horii ..... E02F 3/437

FOREIGN PATENT DOCUMENTS

EP 3904604 A1 11/2021
GB 2485439 A 5/2012
JP 3821260 B2 9/2006
JP 6484595 B2 3/2019
WO 2020188981 A1 9/2020

OTHER PUBLICATIONS

Extended European Search Report for European Patent Appln. No. 23170926.2, mailed Sep. 26, 2023 (7 pgs).

* cited by examiner

*Primary Examiner* — Joseph M Rocca
*Assistant Examiner* — Robert E Pezzuto

(57) ABSTRACT

A machine may include a body, a boom link, a swing casting, and a boom. The boom and the swing casting may be configured to rotate horizontally about an axis through the boom link. The machine may further include a mounting bracket fixedly connected to the swing casting, a position sensor fixedly connected to the boom link, a first link fixedly connected at a first end to the position sensor and configured to rotate about an axis through a rotary element, and a second link fixedly connected at a first end to the mounting bracket and at a second end to a second end of the first link. The first link and the second link may be configured to rotate horizontally with horizontal rotation of the boom and the swing casting and to transfer the horizontal rotation of the boom and the swing casting to the rotary element.

16 Claims, 3 Drawing Sheets

MACHINE WITH A BOOM LINK AND POSITION SENSOR

TECHNICAL FIELD

The present disclosure relates generally to a machine, and more particularly, to a machine with a boom link and position sensor.

BACKGROUND

Machines, such as excavators, may include a boom connected to a body of the machine via a boom link. The boom and boom link may include one or more position sensors to measure movement of the boom. For example, the machine may include a string potentiometer or a gyro-based sensor. However, these types of sensors may often be unreliable or may experience accuracy issues. In addition, these sensors may be located on exposed portions of the boom, such as the exterior of the boom (e.g., on the exterior of a sidewall of the boom), which may result in frequent failure or damage to those sensors from dirt, debris, or contact with objects exterior to the machine. Similarly, the types of configurations and sensors used on machine booms may be limited to measuring movement of the boom in a vertical plane (i.e., extension/retraction or up/down movement) rather than a horizontal plane (i.e., a side-to-side plane). Furthermore, these types of machines may use straight-bar links to connect a position sensor to an element of the machine for measurement of movement of the element. The use of straight-bar links may limit the placement of the position sensor and/or connection points for the links due to space constraints on the machine.

U.S. Pat. No. 9,909,282 B2, granted on Mar. 6, 2018 ("the '282 patent"), describes a work machine that includes a rotary encoder. The rotary encoder is linked to a first link member, which is linked to a second link member, for transmitting the rotation of the boom to the rotary encoder. The rotary encoder, the first link, and the second link are disposed in a vertical plane to measure boom rotation about an axis roughly parallel to the ground. However, the first link and second link are connected to the boom on the exposed exterior of the boom and the configuration of links and rotary encoder are not configured for measuring horizontal rotation of the boom.

The apparatus of the present disclosure may solve one or more of the problems set forth above and/or other problems in the art. The scope of the current disclosure, however, is defined by the attached claims, and not by the ability to solve any specific problem.

SUMMARY

In one aspect, a machine may include a body, a boom link fixedly connected to the body, a swing casting fixedly connected to the boom link, and a boom fixedly connected to the swing casting. The boom and the swing casting may be configured to rotate horizontally about an axis through the boom link. The machine may further include a mounting bracket fixedly connected to the swing casting, a position sensor fixedly connected to the boom link, a first link fixedly connected at a first end to the position sensor and configured to rotate about an axis through a rotary element of the position sensor, and a second link fixedly connected at a first end to the mounting bracket and at a second end to a second end of the first link. The first link and the second link may be configured to rotate horizontally with horizontal rotation of the boom and the swing casting and to transfer the horizontal rotation of the boom and the swing casting to the rotary element of the position sensor.

In another aspect, an apparatus may include a mounting bracket fixedly connected to a swing casting of a machine and a position sensor fixedly connected to a boom link of the machine. The apparatus may further include a first link fixedly connected at a first end to the position sensor and configured to rotate about an axis through a rotary element of the position sensor, and a second link fixedly connected at a first end to the mounting bracket and at a second end to a second end of the first link. The first link and the second link may be configured to rotate horizontally with horizontal rotation of the swing casting of a machine and to transfer the horizontal rotation of the swing casting to the rotary element of the position sensor.

In yet another aspect, a machine may include a boom link and a boom fixedly connected to a swing casting of the machine. The boom and the swing casting may be configured to rotate horizontally about an axis through the boom link. The machine may further include a mounting bracket fixedly connected to the swing casting, a position sensor fixedly connected to the boom link, a first link fixedly connected at a first end to the position sensor and configured to rotate about an axis through a rotary element of the position sensor, and a second link fixedly connected at a first end to the mounting bracket and at a second end to a second end of the first link. The first link and the second link may be configured to rotate horizontally with horizontal rotation of the boom and the swing casting and to transfer the horizontal rotation of the boom and the swing casting to the rotary element of the position sensor. The machine may further include a rotational position system. The rotational position system may be configured to receive data indicative of a horizontal position angle of the position sensor and perform one or more actions based on a horizontal rotation angle of the boom or the swing casting indicated by the horizontal position angle.

Other features and aspects of this disclosure will be apparent from the following description and the accompanying drawings.

BRIEF DESCRIPTION OF THE DRAWINGS

The accompanying drawings, which are incorporated in and constitute a part of this specification, illustrate various exemplary aspects of the disclosure and together with the description, serve to explain the principles of the disclosed aspects.

DETAILED DESCRIPTION

Both the foregoing general description and the following detailed description are exemplary and explanatory only and are not restrictive of the features, as claimed. As used herein, the terms "comprises," "comprising," "has," "having," "includes," "including," or other variations thereof, are intended to cover a non-exclusive inclusion such that a process, method, article, or apparatus that comprises a list of elements does not include only those elements, but may include other elements not expressly listed or inherent to such a process, method, article, or apparatus. In this disclosure, unless stated otherwise, relative terms, such as, for example, "about," "substantially," and "approximately" are used to indicate a possible variation of ±10% in the stated value.

Figure 1:
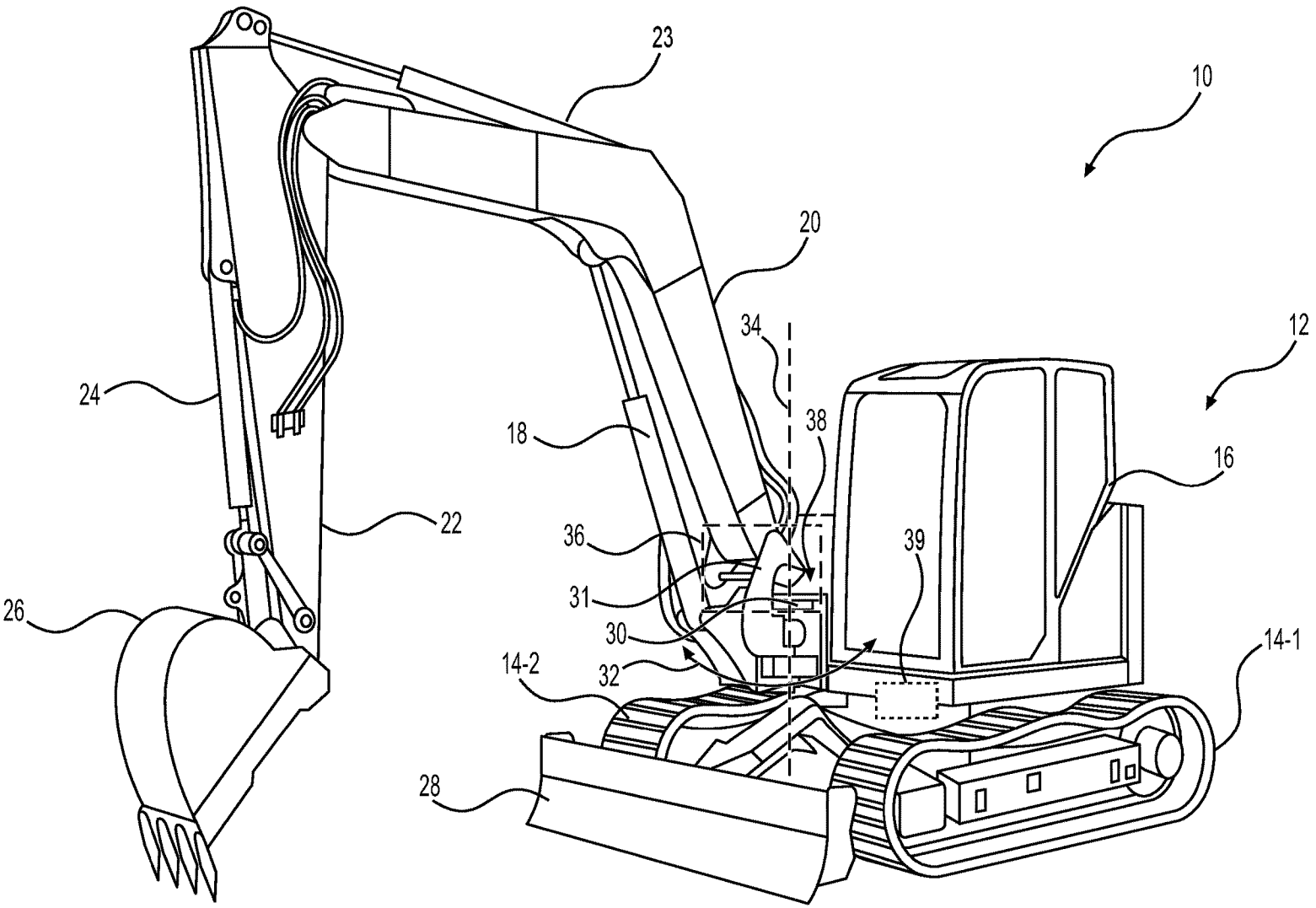
FIG. 1 is a schematic diagram of an exemplary machine, according to aspects of the disclosure.

FIG. 1 is a schematic diagram of an exemplary machine 10, according to aspects of the disclosure. Although FIG. 1 illustrates the machine 10 as being an excavator, the machine 10 may include any type of machine used in mining, construction, paving, logging, etc. with elements that can rotate, such as a tractor, wheel loader, wheel tractor-scraper, skid-steer and compact track loader, track loader, off-highway truck, forest machine, articulated truck, cold planer, dozer, mining excavator, material handler, motor grader, pipeplayer, road reclaimer, telehandler, paver, backhoe loader, etc. The machine 10 can include a body 12, an engine (not illustrated in FIG. 1), a pump (not illustrated in FIG. 1), tracks 14-1 and 14-2, a cabin 16, a first actuator 18, a boom 20, a stick 22, a second actuator 23, a third actuator 24, a first implement 26 (illustrated as a bucket 26, for example), a second implement 28 (illustrated as a blade 28, for example), a boom link 30 fixedly connected to the body 12, a swing casting 31 fixedly connected to an end of the boom 20 and to the boom link 30, a position sensor 38, and a rotational position system 39. The actuators 18, 23, 24 may be hydraulic actuators, electro-mechanical actuators, or any other type of actuator.

The body 12 of the machine 10 may include a chassis, frame, and exterior panels of the machine 10 and may be configured to support and house various components of the machine 10 such as the engine, the pump, the tracks 14-1 and 14-2, the cabin 16, and the rotational position system 39. The engine may include a combustion, electric, hybrid, or other type of motor configured to produce mechanical energy. The pump may include a hydraulic pump connected to the engine and may be powered thereby. In some examples, the pump may be connected to one or more valves for controlling and distributing hydraulic fluid to various actuators of the machine 10, such as the first actuator 18, the second actuator 23, and the third actuator 24. The tracks 14-1 and 14-2 may include a set of movable tracks powered by the engine and connected to the body 12. The tracks 14-1 and 14-2 may be operable by the engine to move the machine 10. In some aspects, the machine 10 may include wheels or other components for moving the machine 10 additionally or alternatively to the tracks 14-1 and 14-2.

The cabin 16 may be connected to the body 12 and configured to enclose an operator therein. The cabin 16 may include various controls mounted therein for controlling the operation of, for example, the engine, the pump, the tracks 14-1 or 14-2, the boom 20, the stick 22, the bucket 26, and the blade 28. The boom 20 may be connected at one end to the body 12 via the swing casting 31 and the boom link 30. For example, the boom 20 may be connected at one end to the swing casting 31, and the swing casting 31 and the boom link 30 may be configured such that when the boom 20 is fixedly connected to the boom link 30 via the swing casting 31, the boom 20 may rotate (via rotation of the swing casting 31) about a vertical axis 34 in a horizontal direction 32 (e.g., horizontally from side-to-side). The machine 10 may be configured with one or more actuators (e.g., hydraulic actuators, electro-mechanical actuators, etc.) to move the boom 20 about the axis 34. The boom 20 may be further configured to rotate about a horizontal axis (not shown in FIG. 1) to lift or lower the boom. The boom 20 may be further fixedly connected at another end to the stick 22, and the stick 22 may be fixedly connected at another end to the bucket 26. Each of the first actuator 18, the second actuator 23, and the third actuator 24 can be connected to and powered by the pump and the rotational position system 39, as noted above. The first actuator 18 may be connected to the body 12 and the boom 20 to actuate the boom 20; the second actuator 23 may be connected to the boom 20 and the stick 22 to actuate the stick 22; and, the third actuator 24 may be connected to the stick 22 and the bucket 26 to actuate the bucket 26. In addition, the machine 10 may be configured with one or more actuators to move the blade 28 (e.g., to change a vertical position of the blade 28, to angle the blade 28 toward a left or right side of the machine 10, etc.).

In some examples, an operator may use the controls within the cabin 16 to move the machine 10 using the tracks 14-1 and 14-2. The operator may further articulate the boom 20 and stick 22 to position the bucket 26 or the blade 28 relative to the body 12. The operator may use various controls to tilt, rotate, and scoop or curl the bucket 26 to perform various tasks, such as moving dirt and other materials during an excavating process. Similarly, the operator may use various controls to adjust a height, rotation, angle, etc. of the blade 28. Although FIG. 1 illustrates a bucket 26 and a blade 28 as example implements, other implements may be used, such as a drill, cutters, a breaker, a scraper, etc.

As further illustrated in FIG. 1, the machine 10 may further include a position sensor 38, which may be attached to the boom link 30, in some examples. The mechanical junction of the swing casting 31 to the boom link 30, illustrated by the area 36, and the mechanical configuration of the position sensor 38 and other elements are described in more detail in connection with FIG. 2.

The position sensor 38 may include, e.g., a rotary potentiometer or a hall effect sensor. In some aspects, the position sensor 38 may operate according to controller area network (CAN) standards or may include an analog sensor. The position sensor may be communicatively connected to the rotational position system 39. The rotational position system 39 may have hardware and/or software-based components for monitoring, controlling, and communicating with the machine 10 (or components thereof, such as the tracks 14-1 and 14-2, the boom 20, the stick 22, the actuators 18, 23, or 24, the bucket 26, and/or the position sensor 38). In some aspects, the rotational position system 39 may receive data from the position sensor 38.

The rotational position system 39 may include one or more server devices, processors, and/or memory located on-board the machine 10 or located remote from the machine 10. In this way, certain aspects may process data remote from the position sensor 38 and/or the machine 10. In the illustrated example, the memory of the rotational position system 39 may store software-based components to perform various processes and techniques described herein, including the method illustrated in FIG. 3.

A processor may include a central processing unit (CPU), a graphics processing unit (GPU), a microprocessor, a digital signal processor and/or other processing units or components. Additionally, or alternatively, the functionality described herein can be performed, at least in part, by one or more hardware logic components. For example, and without limitation, illustrative types of hardware logic components that may be used include field-programmable gate arrays (FPGAs), application-specific integrated circuits (ASICs), application-specific standard products (ASSPs), system-on-a-chip systems (SOCs), complex programmable logic devices (CPLDs), etc. Additionally, the processor may possess its own local memory, which also may store program modules, program data, and/or one or more operating systems. The processor may include one or more cores.

Memory may be a non-transitory computer-readable medium that may include volatile and/or nonvolatile memory, removable and/or non-removable media implemented in any method or technology for storage of information, such as computer-readable instructions, data structures, program modules, or other data. Such memory includes, but is not limited to, random access memory (RAM), read-only memory (ROM), electrically erasable programmable read-only memory (EEPROM), flash memory or other memory technology, compact disc read-only memory (CD-ROM), digital versatile discs (DVD) or other optical storage, magnetic cassettes, magnetic tape, magnetic disk storage or other magnetic storage devices, redundant array of independent disks (RAID) storage systems, or any other medium which can be used to store the desired information and which can be accessed by a computing device (e.g., a user device, a server device, etc.). The memory may be implemented as computer-readable storage media (CRSM), which may be any available physical media accessible by the processor to execute instructions stored on the memory. The memory may have an operating system (OS) and/or a variety of suitable applications stored thereon. The OS, when executed by the processor, may enable management of hardware and/or software resources of the rotational position system 39.

Figure 2:
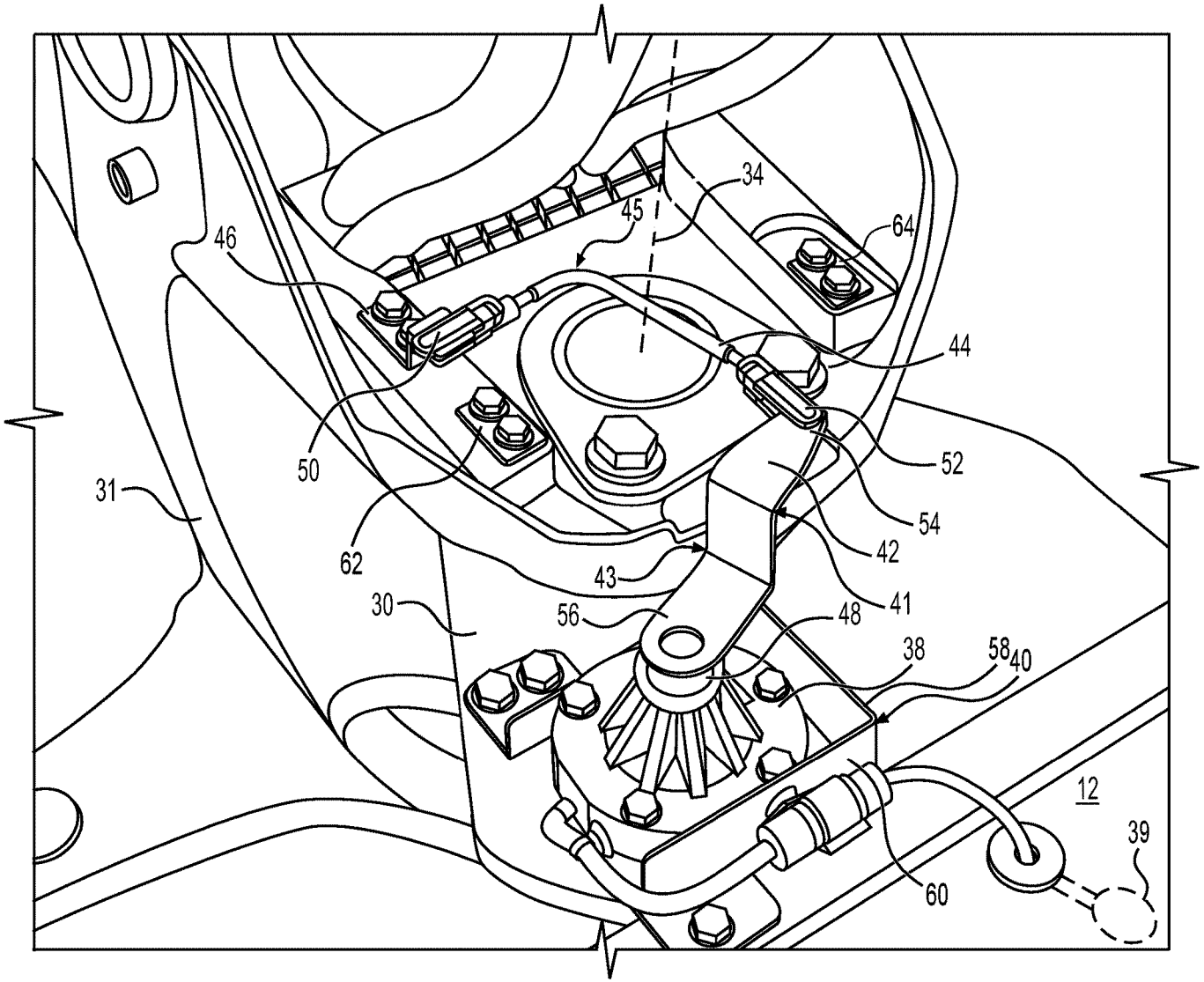
FIG. 2 is a perspective view of a portion of the machine of FIG. 1, according to aspects of the disclosure.

FIG. 2 is a perspective view of a portion of the machine 10 of FIG. 1, according to aspects of the disclosure. In particular, FIG. 2 illustrates a perspective view of the area 36 illustrated in FIG. 1 (the mechanical junction of the swing casting 31 and the boom link 30) from the perspective of the body of the machine 10 looking toward the boom 20.

As illustrated in FIG. 2, the position sensor 38 may be fixedly attached to the boom link 30 in a manner such that the rotary element 48 of the position sensor 38 can rotate about a vertical axis (e.g., side-to-side). In addition, the position sensor 38 may be fixedly attached to the boom link 30 for movement with the body 12. In this way, the position sensor 38 may be oriented to capture rotation of the boom 20 within a desired operating range of the position sensor 38. The machine 10 may further include a first link 42 fixedly connected to the position sensor 38. For example, the first link 42 may be fixedly connected to the rotary element 48 at a first end 56 of the first link 42 such that the first link 42 can transfer horizontal rotation of the boom 20 (via the swing casting 31) about the vertical axis 34 to the rotary element 48 of the position sensor 38. The first link 42 may be further fixedly connected to a second link 44. For example, a second end 54 of the first link 42 may be fixedly connected to a first end 52 of the second link 44. The first link 42 and the second link 44 may be connected such that the first link 42 and the second link 44 can rotate horizontally about an axis through the connection point at the end 54 and the end 52 with horizontal rotation of the swing casting 31. The second link 44 may be further fixedly connected at a second end 50 of the second link 44 to a mounting bracket 46, which may be fixedly connected to the swing casting 31. The second link 44 may be connected to the mounting bracket 46 such that the movement of the boom 20 may be transferred to the second link 44 via the swing casting 31, which may transfer the movement to the first link 42. The connection points at ends 48, 50, and 52 may be configured to allow rotation about a vertical axis through the connection points as the swing casting 31 rotates about the vertical axis 34, in some implementations.

As further illustrated in FIG. 2, the first end 52 and second end 54 of the second link 44 may include yoke-type ends for connection to the first link 42 and the mounting bracket 46. Additionally, or alternatively, the first end 52 and second end 50 of the second link 44 may have adjustable ends (e.g., screw-type or telescopic-type adjustable ends) for modification of the length of the first end 52 and second end 54, which may facilitate use of the second link 44 with various configurations of components. This configuration of the second link 44 is provided merely as an example, and any configuration for connecting the second link 44 to the first link 42 and the mounting bracket 46 may be used. Similarly, the first link 42, the mounting bracket 46, and the rotary element 48 may include any configuration for mechanical connection to the components described herein. Although FIG. 2 illustrates two links 42, 44, certain examples may include one, three, four, etc. links. In addition, although FIG. 2 illustrates the two links 42, 44 fixedly connected to each other at ends 52, 54, certain examples may have the links 42, 44 fixedly connected to each other at other points, such as at middle points of the links 42, 44. Furthermore, certain connection points between elements that have been described as allowing rotation about an axis may be static connection points (e.g., may be configured so rotation is not possible), in some implementations.

As further illustrated in FIG. 2, the first link 42 and the second link 44 may have bends in various planes. For example, the first link 42 may have at least one bend in a vertical plane as installed (FIG. 2 illustrates two bends 41, 43 forming a step, for example) such that the ends 54, 56 are at different elevations when the first link 42 is installed. The bends in the vertical plane may help facilitate transfer of the horizontal movement of the boom 20 from elements within an interior or enclosed/covered portion of the boom 20 or swing casting 31 to the position sensor 38, which may be located at a different elevation from the second link 44. As another example, the second link 44 may have at least one bend in the horizontal plane as installed (FIG. 2 illustrates a single bend 45, for example) such that the ends 50, 52 are at the same elevation when the second link 44 is installed. The bends in the horizontal plane may help facilitate mounting of the first link 42 within an interior or partially covered/enclosed portion of the boom 20 and/or the swing casting 31. This may help to reduce or eliminate damage that might otherwise occur to components mounted on an exposed exterior of the boom 20. Although the first link 42 and the second link 44 have been described as each including at least one bend, the first link 42 and/or the second link 44 may not include any bends (e.g., may be straight elements), and the specific shape of the first link 42 and/or the second link 44 may depend on space constraints of the machine 10. The first link 42 and the second link 44 (or components thereof) may be generally stiff or rigid and may comprise one or more materials, such as a metal, a plastic, an alloy, and/or the like.

The machine 10 may include various coverings or casings for elements illustrated in FIG. 2. For example, the machine 10 may include a casing 40 (only partially shown in FIG. 2) that at least partially covers the position sensor 38 and at least partially covers the first link 42. Continuing with this example, the casing 40 may include one or more walls and a lid that partially covers the position sensor 38 and has one or more openings to allow for movement of the first link 42 (e.g., FIG. 2 illustrates two walls 58, 60 of the casing 40, where the first link 42 rotates with clearance above the two walls 58, 60). As another example, the machine 10 may include a plate (not illustrated in FIG. 2) that at least partially covers the mounting bracket 46 and at least partially covers the second link 44. Continuing with this example, the plate may extend from mounting position 62 to mounting position 64 over the second link 44. The covers over various elements illustrated in FIG. 2 may provide protection to those components from dirt, debris, or contact damage relative to having elements attached to an exterior wall of the boom 20 (e.g., an exterior side wall). In addition, the coverings may protect the elements (or portions thereof) throughout a range of motion as the boom 20 and/or swing casting 31 rotate about the axis 34.

In some aspects, the elements described herein may be configured in different manners than those illustrated in FIG. 2. For example, although FIG. 2 illustrates the position sensor 38 being fixedly connected to the boom link 30 and the mounting bracket 46 being fixedly connected to the swing casting 31, the position sensor 38 may be fixedly connected to the boom 20 or the swing casting 31 and the mounting bracket 46 may be fixedly connected to the boom link 30 or the body 12. In this case, the first link 42 and the second link 44 may be re-positioned and/or re-configured accordingly, or a different set of links may be used. For example, one or more links may connect the position sensor 38 on the boom 20 or the swing casting 31 to the boom link 30 or the body 12.

INDUSTRIAL APPLICABILITY

The disclosed aspects of the rotational position system 39 of the present disclosure may be used to determine a horizontal rotation angle of the boom 20 to perform various actions related to the horizontal rotation angle, such as modifying the position of the boom 20. Thus, certain aspects described herein may provide various advantages to operation of a machine 10. For example, by using a position sensor 38 rather than other measurement components, such as a string potentiometer, certain aspects may be capable of more reliable or accurate measurements of rotation of the boom 20. In addition, the configuration of certain elements of the machine 10, such as certain elements illustrated in FIG. 2, may facilitate placement of those elements in the interior of the boom 20 or swing casting 31 (or other similar enclosed or partially enclosed portion of the boom 20 or swing casting 31). For example, certain elements may be attached to an interior of a hollow portion of the boom 20 or swing casting 31 and/or may be positioned between sidewalls of a partially enclosed portion of the boom 20 or swing casting 31. This may protect the elements for measurement of the horizontal rotation of the boom 20 from damage while at a worksite, which may reduce or eliminate a need to repair the machine 10, may help to maintain an accuracy of the horizontal rotation measurements, and/or the like. For example, by having certain measurement elements placed in the interior of the boom 20 or swing casting 31, the elements may be protected from contact damage by debris or other objects, especially compared to having the measurement elements placed on the exterior of the boom 20 or the swing casting 31.

Figure 3:
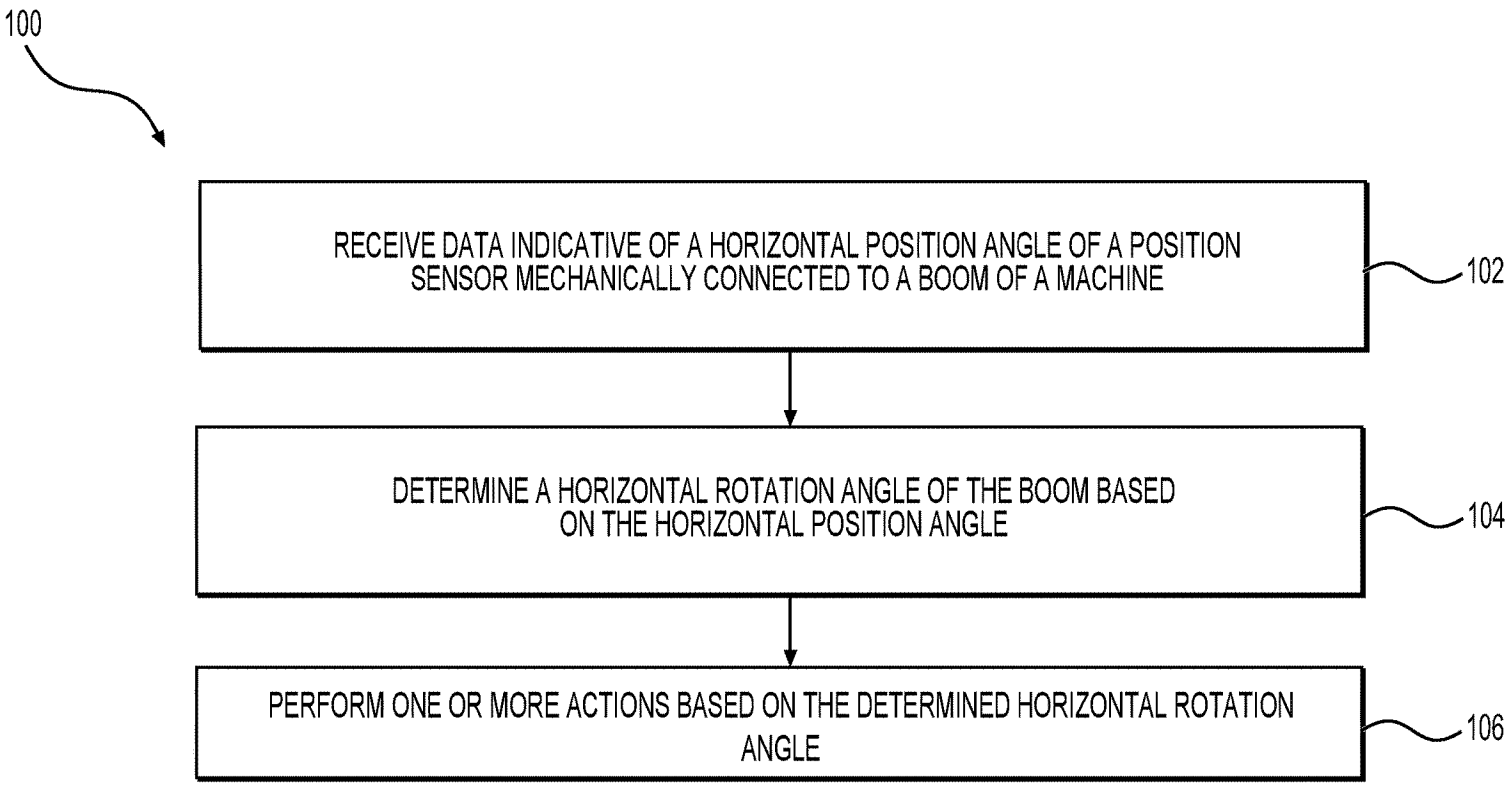
FIG. 3 illustrates a flowchart depicting an exemplary method for determining a rotational position of a boom of the machine of FIG. 1, according to aspects of the disclosure.

FIG. 3 illustrates a flowchart depicting an exemplary method 100 for determining a rotational position of a boom 20 of the machine 10 of FIG. 1, according to aspects of the disclosure. The method 100 illustrated in FIG. 3 may be implemented by the rotational position system 39. The steps of the method 100 described herein may be embodied as machine readable and executable software instructions, software code, or executable computer programs stored in a memory and executed by a processor of the rotational position system 39. The software instructions may be further embodied in one or more routines, subroutines, or modules and may utilize various auxiliary libraries and input/output functions to communicate with other equipment. The method 100 illustrated in FIG. 3 may also be associated with an operator interface (e.g., a human-machine interface, such as a graphical user interface (GUI)) through which an operator of the machine 10 may view data associated with the horizontal rotation of the boom 20 and/or may control operations of the machine 10. Therefore, the method 100 may be implemented by the rotational position system 39 to provide for determining and/or modifying a horizontal rotation position of the boom 20. For example, the rotational position system 39 may determine the horizontal rotation position of the boom 20 and may perform one or more actions based on the determined horizontal rotation position.

At step 102, the method 100 may include receiving data indicative of a horizontal position angle of position sensor 38 fixedly connected to boom 20 of machine 10. For example, the rotational position system 39 may receive the data from the position sensor 38 as the boom 20 is rotated horizontally about the vertical axis 34 through the swing casting 31, may receive the data according to a schedule, may receive the data in a streaming manner, and/or the like. In some implementations, the position sensor 38 may provide the data based on receiving a command from the rotational position system 39 or an operator of the machine 10. The data may indicate the horizontal position angle of the position sensor 38 by indicating a degree of rotation of the rotary element 48 of the position sensor 38 about an axis through the rotary element 48.

The method 100 may include, at 104, determining a horizontal rotation angle of the boom 20 based on the horizontal position angle. For example, the rotational position system 39 may determine the horizontal rotation angle in real-time (or near real-time) after receiving the data, at a later time after receiving the data, based on receiving a command from an operator of the machine 10 to determine the horizontal rotation angle, and/or the like. The rotational position system 39 may store information for converting the horizontal position angle of the position sensor 38 to the horizontal rotation angle of the boom 20. For example, the information may include conversion tables, models, and/or the like calibrated to take a horizontal position angle (e.g., in degrees) as input and to output the calibrated horizontal rotation angle (e.g., in degrees). In some implementations, the conversion from a horizontal position angle to a horizontal rotation angle may be linear (e.g., a 1 degree rotation in the position sensor 38 may correspond to a 1 degree rotation in the boom 30 or swing casting 31) or may be some other conversion (e.g., a certain degree of rotation in the position sensor 38 may correspond to a different degree of rotation in the boom 20 or swing casting 31). Additionally, or alternatively, and as explained elsewhere herein, the configuration of the components of the machine 10 may transfer planar movement of the boom 20 to planar movement of the position sensor 38, which may facilitate more accurate or reliable measurement of the rotation of the boom 20 relative to a multidimensional analysis (e.g., converting the horizontal movement of the boom 20 to rotation of the position sensor 38 in a vertical plane).

The method 100 may include, at 106, performing one or more actions based on the determined horizontal rotation angle. For example, the rotational position system 39 may perform one or more actions in real-time (or near real-time) after determining the horizontal rotation angle, at a later time after determining the horizontal rotation angle, based on a command from a user of the machine 10, and/or the like. The one or more actions may include, for example, modifying the horizontal rotation angle of the boom 20 by actuating one or more actuators associated with the boom 20. For example, the rotational position system 39 may send one or more commands to the one or more actuators to cause rotation of the boom 20 via rotation in the swing casting 31 in a horizontal direction about the vertical axis 34. Additionally, or alternatively, the one or more actions may include displaying the horizontal rotation angle after receiving the data. For example, the rotational position system 39 may display the horizontal rotation angle, a visual representation of the horizontal rotation angle, and/or the like via a display of the machine 10. Additionally, or alternatively, the one or more actions may include triggering an alarm based on the horizontal rotation angle exceeding a limit. For example, there may be limits to the amount that the boom 20 can rotate in a certain direction based on an operation environment or operating limits of the machine 10, and the rotational position system 39 may trigger an alarm when the limit (or certain thresholds preceding the limit) are met or exceeded.

Additionally, or alternatively, the one or more actions may include, for example, one or more operator-assist actions. For example, the rotational position system 39 may provide output that guides an operator in moving the boom 20 from a current position to a desired position, that notifies an operator when the boundaries of a work area are reached, and/or the like. Additionally, or alternatively, the one or more actions may include, for example, grade control actions. For example, the rotational position system 39 may output information or control the position of the boom 20 to achieve or maintain a grade at a worksite or to achieve or maintain other worksite characteristics (e.g., consistent work area size or shape). Additionally, or alternatively, the one or more actions may include, for example, autonomous operations. For example, the rotational position system 39 may autonomously operate the position of the boom 20 based on the determined horizontal rotation angle of the boom 20 (e.g., to cause the boom 20 to move to a pre-programmed or user-input position).

Although the method 100 illustrated in FIG. 3 is described as including steps 102 through 106, the method 100 may not include all of these steps or may include additional or different steps. For example, the method 100 may just include the operations at 102 and 106 (e.g., the rotational position system 39 may perform the one or more actions based on the horizontal position angle rather than first determining the horizontal rotation angle based on the horizontal position angle).

In this way, certain aspects of the disclosure may provide for measurement of a horizontal rotation of a boom 20 (or swing casting 31) of a machine 10 and performance of certain actions based on the measurements. This may help to improve operations of the machine 10 by facilitating autonomous operations, preventing operations that may damage the machine 10, and/or the like. This may help to reduce damage to the machine 10 that might otherwise occur, improve an accuracy of operations of the machine 10, and/or the like. By reducing or eliminating damage or improving an accuracy of the operations, certain aspects may reduce downtime of the machine 10 or reduce an amount of maintenance needed for the machine 10. In addition, certain aspects may provide for mounting of components for measuring the horizontal rotation within an interior or partially enclosed/covered portion of the boom 20 or swing casting 31. For example, the boom 20 and/or swing casting 31 may have a hollow structure or a portion with sidewalls and certain components may be mounted within the hollow portion or between the sidewalls for protection from external debris or contact with objects external to the machine 10. This may help to reduce or eliminate damage to the components that might otherwise occur if mounted to an exterior of the boom 20 or swing casting 31. By reducing or eliminating damage to the measurement components, certain aspects of the disclosure may reduce downtime of the machine 10, reduce an amount of maintenance needed for the machine 10, maintain an accuracy of the measurement components for a longer period of time, and/or the like.

It will be apparent to those skilled in the art that various modifications and variations can be made to the disclosed system without departing from the scope of the disclosure. Other aspects of the system will be apparent to those skilled in the art from consideration of the specification and practice of the system disclosed herein. It is intended that the specification and examples be considered as exemplary only, with a true scope of the disclosure being indicated by the following claims and their equivalents.

What is claimed is:

1. A machine, comprising:

a body;

a boom link connected to the body;

a swing casting rotatably connected to the boom link;

a boom rotatably connected to the swing casting, wherein the boom and the swing casting are configured to rotate horizontally about a first axis through the boom link;

a mounting bracket connected to the swing casting;

a position sensor connected to the boom link;

a first link rotatably connected at a first end to the position sensor and configured to rotate about a second axis through a rotary element of the position sensor;

a second link connected at a first end to the mounting bracket and at a second end to a second end of the first link;

a first casing that at least partially covers the mounting bracket and the second link; and a second casing that at least partially covers the position sensor and the first link, wherein the first link and the second link are configured to rotate horizontally with horizontal rotation of the boom and the swing casting and to transfer the horizontal rotation of the boom and the swing casting to the rotary element of the position sensor, and wherein the first link has at least one bend in a vertical plane such that the first end and the second end of the first link are at different elevations when installed and the second link has at least one bend in a horizontal plane such that the first end and the second end of the second link are at a same elevation when installed.

2. The machine of claim 1, wherein the mounting bracket is connected to the swing casting within an interior of the swing casting.

3. The machine of claim 1, wherein the machine further comprises a rotational position system.

4. The machine of claim 3, wherein the rotational position system is configured to:

receive data indicative of a horizontal position angle of the position sensor; and perform one or more actions based on a horizontal rotation angle of the boom indicated by the horizontal position angle.

5. An apparatus, comprising:

a mounting bracket connected to a swing casting of a machine;

a position sensor connected to a boom link of the machine;

a first link rotatably connected at a first end to the position sensor and configured to rotate about an axis through a rotary element of the position sensor;

a second link rotatably connected at a first end to the mounting bracket and at a second end to a second end of the first link;

a first casing that at least partially covers the mounting bracket and the second link; and a second casing that at least partially covers the position sensor and the first link, wherein the first link and the second link are configured to rotate horizontally with horizontal rotation of the swing casting of the machine and to transfer the horizontal rotation of the swing casting to the rotary element of the position sensor, and wherein the first link has at least one bend in a vertical plane such that the first end and the second end of the first link are at different elevations when installed and the second link has at least one bend in a horizontal plane such that the first end and the second end of the second link are at a same elevation when installed.

6. The apparatus of claim 5, wherein the mounting bracket is fixedly connected to an interior of the swing casting of the machine.

7. The apparatus of claim 6, wherein the position sensor is connected to the boom link of the machine at a different elevation than an elevation at which the mounting bracket is connected to the swing casting.

8. The apparatus of claim 5, wherein the position sensor is communicatively connected to a rotational position system.

9. The apparatus of claim 8, wherein the rotational position system is configured to:

receive data indicative of a horizontal position angle of the position sensor; and perform one or more actions based on a horizontal rotation angle of the swing casting or a boom of the machine indicated by the horizontal position angle.

10. A machine, comprising:

a boom link;

a boom connected to a swing casting of the machine, wherein the boom and the swing casting are configured to rotate horizontally about a first axis through the boom link;

a mounting bracket connected within an interior of the swing casting;

a position sensor connected to the boom link;

a first link rotatably connected at a first end to the position sensor and configured to rotate about a second axis through a rotary element of the position sensor;

a second link connected at a first end to the mounting bracket and at a second end to a second end of the first link, wherein the first link and the second link are configured to rotate horizontally with horizontal rotation of the boom and the swing casting and to transfer the horizontal rotation of the boom and the swing casting to the rotary element of the position sensor; and a rotational position system, wherein the rotational position system is configured to:

receive data indicative of a horizontal position angle of the position sensor; and perform one or more actions based on a horizontal rotation angle of the boom or the swing casting indicated by the horizontal position angle.

11. The machine of claim 10, wherein the rotational position system is further configured, when receiving the data, to:

receive the data from the position sensor.

12. The machine of claim 10, wherein the rotational position system is further configured to:

determine the horizontal rotation angle after receiving the data.

13. The machine of claim 10, wherein the one or more actions comprise one or more of:

displaying information indicative of the horizontal rotation angle, triggering an alarm based on the horizontal rotation angle exceeding a limit, modifying the horizontal rotation angle by actuating one or more actuators associated with the boom or the swing casting of the machine, performing one or more grade control actions, or performing one or more autonomous actions.

14. The machine of claim 10, wherein the first link has at least one bend in a vertical plane such that the first end and the second end of the first link are at different elevations when installed and the second link has at least one bend in a horizontal plane such that the first end and the second end of the second link are at a same elevation when installed.

15. The machine of claim 10, further comprising:

a first casing that at least partially covers the mounting bracket and the second link; and a second casing that at least partially covers the position sensor and the first link.

16. The machine of claim 10, wherein the machine comprises an excavator.

* * * * *